US009510072B2

(12) United States Patent
Newman

(10) Patent No.: US 9,510,072 B2
(45) Date of Patent: Nov. 29, 2016

(54) SOUND DIVERTER

(71) Applicant: Bret Arden Newman, Columbus, OH (US)

(72) Inventor: Bret Arden Newman, Columbus, OH (US)

( * ) Notice: Subject to any disclaimer, the term of this patent is extended or adjusted under 35 U.S.C. 154(b) by 143 days.

(21) Appl. No.: 14/659,767

(22) Filed: Mar. 17, 2015

(65) Prior Publication Data

US 2016/0277820 A1 Sep. 22, 2016

(51) Int. Cl.

| | |
|---|---|
| ***H04R 25/00*** | (2006.01) |
| ***H04R 1/02*** | (2006.01) |
| ***H04R 1/34*** | (2006.01) |

(52) U.S. Cl.
CPC ..... *H04R 1/028* (2013.01); *H04R 1/345* (2013.01); *H04R 2499/15* (2013.01)

(58) Field of Classification Search
CPC ... H04R 1/028; H04R 1/345; H04R 2499/15
USPC ..... 381/160, 337–342, 350, 352; 181/177, 181/191
See application file for complete search history.

(56) References Cited

U.S. PATENT DOCUMENTS

| | | | | |
|---|---|---|---|---|
| D397,118 | S * | 8/1998 | Keating | D14/221 |
| 7,778,431 | B2 | 8/2010 | Feng | |
| 8,731,219 | B2 | 5/2014 | Weiss | |
| 2012/0241247 | A1* | 9/2012 | Choe | H04R 1/345 181/191 |
| 2013/0004012 | A1* | 1/2013 | Huang | A45C 11/00 381/388 |

FOREIGN PATENT DOCUMENTS

WO PCTUS2012068683 10/2012

* cited by examiner

*Primary Examiner* — Vivian Chin
*Assistant Examiner* — Friedrich W Fahnert
(74) *Attorney, Agent, or Firm* — R. William Graham

(57) ABSTRACT

A sound diverter for use with an electronic device which has one or more speakers, wherein the sound diverter is operably connected to the device enhancing the sound emitted from the speaker.

14 Claims, 1 Drawing Sheet

12
20
14
11
10
16
18
20

15
18
13
17
24
10

10
12
16
20
18

12
14
10
19

10
14
12
19
20
16
18

10
20
16
12
22
23
18

SOUND DIVERTER

FIELD OF INVENTION

The present invention relates a sound diverter for use with electronic devices. More particularly, the sound diverter of the instant invention is an improvement over the art in proving a universal adaptable configuration to permit useful adaptation to a plurality of electronic devices, such as, but not by way of limitation, numerous modern flat LCD or LED screen televisions having a thin profile containing a speaker in a side, top or bottom of its housing, in combination with the sound diverter to enhance the volume and quality of the sound from the speaker.

BACKGROUND OF INVENTION

As the current electronic screen devices have continuously sought to streamline their design into thinner configurations and maximizing screen size, they have integrated speakers into the back, top, bottom or sides of the television unit. This has resulted in poorer sound qualify to the end user.

Accordingly, there are various sound reflector products which have been invented which are tailored to a specific devices. For example, U.S. Pat. No. 8,731,219 discloses a sound reflective device for an iPad® which contains a loudspeaker in the side of its case for providing the user with audio associated. Another device seen in U.S. Pat. No. 7,778,431 provides a sound enhancing stand for a phone, for example, wherein the phone lays on the stand. Such sound reflectors are designed to adapt to a particular or limited product size configuration. There remains a need in the art to improve the field of sound diverters. The instant invention fulfills such need.

BRIEF SUMMARY OF INVENTION

It is an object of the instant invention to provide a novel sound diverter that acts to enhance sound emanating from an electronic device, particularly a flat screen television, containing one or more speakers in the side, top or bottom of its housing.

A further object of the invention is to provide a sound diverter which is configured to universally adapt to a plurality of television configurations.

The sound diverter according to the present invention is an improvement over the art in providing a universal adaptable configuration to permit useful adaptation to a plurality of electronic device configurations, such as, but not by way of limitation, multiple modern flat LCD or LED screen televisions having a thin profile containing a speaker in a side, top or bottom of its housing, in combination with the sound diverter to enhance the volume and quality of the sound from the speaker.

The sound diverter includes a longitudinal member connected by way of breakable tabs to a ledge having a concave surface extending inwardly therefrom and which is for disposal adjacent the speaker of an electronic device for diverting sound from the speaker. There is at least one, and preferable two, recessed surfaces laterally extending from the ledge on either side of the concave surface. Depending on the configuration of the particular electronic device, e.g., t.v., to which the sound diverter is to be attached, either the longitudinal member, recessed surfaces or both can be used for attaching the sound diverter to the electronic device. A removable connector can be employed which interconnects the longitudinal member and back of the electronic device. In one configuration, the removable connector can include a hook and loop member adhesively connected to the longitudinal member and the back of the electronic device with the ledge disposed about a speaker having the concave surface extending over the speaker leaving an open end of the concave surface facing forward. In another configuration in order that the concave be placed over the speaker, it may require the longitudinal member be snapped off at the tabs thereby enabling positioning over the speaker and in this configuration hook and loop member, for example, adhesively interconnects the recessed surfaces to an edge of the t.v., such that the concave surface is over the speaker leaving an open end of the concave surface facing forward. Note that the recessed surfaces in combination with the removable connector permit the ledge to remain relatively flush against the t.v. edge surface. The connection may be done by hook and loop or other removably connectable means. Note, the performance of the sound diverter is enhanced by maintaining the ledge of the sound diverter against the surface of the device thereby maximizing the deflection of the sound waves off the concave surface. The incorporation of magnetic coupling is recognized as one means to enhance the sound reflection. In so providing, there is apparent amplification of sound from the speaker of the electronic device achieved by confining the sound energy within and through the sound diverter with the sound energy emerging at the open end of the sound diverter.

Another aspect of the invention is to an improved flat screen television having a housing which includes a forwardly disposed and exposed screen and speaker operabiy disposed in side in a manner to permit sound therefrom to emanate through one or more opening in housing adjacent the speaker. The improvement includes the sound diverter for enhancing sound emitted from the speaker, the sound diverter including concave surface extending from the side and about and over speaker for diverting sound from the speaker and providing open end of concave surface facing forward.

It is further contemplated that there can be provided a double sided foam tape configured to sealably interconnect the longitudinal or ledge to the electronic device, but that hard surface to surface connections may perform better as they do not absorb any sound wave.

DETAILED DESCRIPTION OF THE INVENTION

Figures 1, 2, 3, 4, 5, 6:
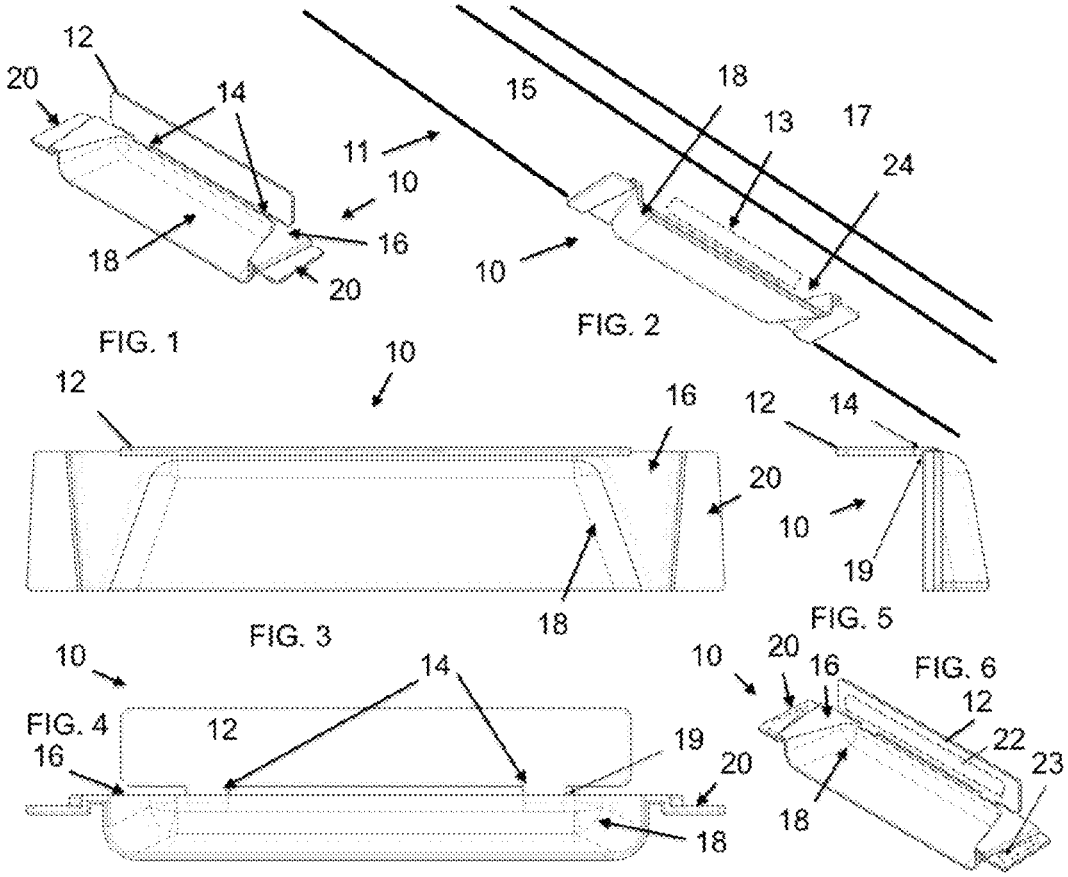
FIG. 1 is a perspective view of a sound diverter according to the present invention.
FIG. 2 is a perspective view of a sound diverter according to the present invention illustrating its use.
FIG. 3 is a top view thereof.
FIG. 4 is a front view thereof.
FIG. 5 is a right side view thereof of which the left side is a mirror image.
FIG. 6 is a view of another aspect of according to the invention.

Referring now to the drawings, the present invention relates a sound diverter which is generally referred to by the numeral 10. The sound diverter 10 is an improvement over the art in providing a universal adaptable configuration to permit useful adaptation to a plurality of electronic devices, such as, but not by way of limitation, modern flat LCD or LED screen television 11 having a thin profile containing a speaker 13 in a side, top or bottom of a housing 15, which in combination with the sound diverter 10 to enhance the volume and quality of the sound from the speaker 13.

The sound diverter 10 can preferably be made of plastic, such as polypropylene, polyethylene, or PVC, although other plastic materials, such as polycarbonate compounds, metal, for example. The sound diverter 10 has a longitudinal member 12 connected by way of one or more breakable tabs 14 having a break portion 19 connecting to a ledge 16. The ledge 16 has a concave surface 18 extending inwardly therefrom and which is for disposal adjacent the speaker 13 for diverting sound from the speaker 13.

There are two recessed surfaces 20 laterally extending from the ledge 16 on either side of the concave surface 18. Depending on the configuration of the particular electronic device, e.g., t.v. 11, to which the sound diverter 10 is to be attached, either the longitudinal member 12, recessed surfaces 20 or both can be used for attaching the sound diverter 10 to the electronic device. For example, removable connector 22 can be employed for interconnecting the longitudinal member 12 and back of the electronic device 11. In one configuration, the removable connector 22 can include a hook and loop member (Velcro®) adhesively connected to the longitudinal member 12 and the back of the electronic device 11 with the ledge 16 adjacent and in contact with the side 15 of the device 11 and the concave surface 18 disposed about speaker 13. The concave surface 18 extends over the speaker 13 leaving an open end 24 of the concave surface 18 facing forward. In another configuration in order that the concave surface 18 be placed over the speaker 13, it may require the longitudinal member 12 be snapped off at the tabs 14 thereby enabling positioning over the speaker 13 and in this configuration hook and loop member 23 adhesively interconnect the recessed surfaces 20 to side 15 of the t.v. 11, such that the concave surface 18 is over the speaker 13 leaving open end 24 of the concave surface 18 facing forward. Note that the recessed surfaces 20 permit the ledge 16 to remain relatively flush against the side 15. The connection may be done by hook and loop or other removably connectable means. Note, the performance of the sound diverter 10 is enhanced by maintaining the ledge 16 of the sound diverter 10 against the side 15 of the device 11 thereby maximizing the deflection of the sound waves off the concave surface 18. The incorporation of magnetic coupling is recognized as one means to enhance the sound reflection.

In so providing, there is apparent amplification of sound from the speaker 13 of the electronic device 11 achieved by confining the sound energy within and through the sound diverter 10 with the sound energy emerging at the open end 24 of the sound diverter 10.

It is further contemplated that there can be provided a double sided foam tape configured to the sealably interconnect the longitudinal or ledge to the electronic device. Hard surface to surface connections may perform better as they do not absorb any sound wave as may be the case with foam or rubber connection.

The sound diverter 10 according to the invention produces a noticeable improvement in sound volume and qualify. Applicant makes no claim to actual amplification of the sound energy; however, by redirecting the sound toward the listener, the listener will hear a much louder sound and a clearer sound quality. According to one preferred embodiment of the invention, the sound diverter 10 measures about 8.5" in length by 1.5" in width and 2.5" in height with longitudinal member 12 or about 1.5" in height with the longitudinal member 12 and tabs 14 removed. It is envisioned the size can be varied from that indicated in the specific embodiment and the invention intends to cover such variations. The concave surface 18 includes a radius of curvature of about 0.375. It is recognized that these dimensions and shapes can be varied but that these dimensions sufficiently cover numerous televisions on the market. The sound diverter 10 may be provided with dimensions, including the radius of curvature of concave portion 18, specific to the electronic for which if is designed, in order to maximize the natural tone heard when directed toward the user's ears so the most sound is reflected toward the ears to enable the user to hear the sound more clearly in relation to the specific device to which the sound diverter is being applied.

Another aspect of the invention is to an improved flat screen television 11 having a housing which includes a forwardly disposed and exposed screen 17 and speaker 13 operably disposed in side 21 in a manner to permit sound therefrom to emanate through one or more opening 23 in housing 15 adjacent the speaker 13. The improvement includes the sound diverter 10 for enhancing sound emitted from the speaker 13, the sound diverter 10 including concave surface 18 extending from the side 21 and about and over speaker 13 for diverting sound from the speaker 13 and providing open end 24 of concave surface 18 facing forward.

Various materials may be used for the sound diverter 10, such as metallic, metallic thermoplastic compounds and/or magnetic thermoplastic compounds. Different materials may affect and enhance sound reflection in different ways, such as metals, materials with magnetic or metallic properties that may create enhanced natural tones of sound when directed to one's ears. Sound Diverters according to the invention can be produced in any pantone color and include customized logos.

What is claimed is:

1. A reflector for enhancing the sound emitted from a loudspeaker of an electronic device, the loudspeaker being disposed at a location in the electronic device, said reflector comprising:

at least one component for attaching said reflector to an edge of the electronic device at the location of the loudspeaker;

a flat portion located to be adjacent a surface of the electronic device, and a concave portion adjacent to, and extending from, the flat portion and presenting a concave surface to the loudspeaker, wherein said flat portion has a free end and said reflector is constructed to cause said free end to form a seal with an outer surface of the electronic device, and said reflector further comprises a magnet located in said flat portion.

2. The reflector of claim 1 wherein said magnet is a flat magnet.

3. The reflector of claim 2, wherein said flat portion of said reflector is provided With a recess for retaining said magnet and said reflector is constructed to allow said magnet to be removed from said recess and reinstalled therein.

4. The reflector of claim 1 wherein said magnet is cylindrical and is transversely polarized, and further wherein said flat portion is provided with a recess dimensioned to receive said magnet and to permit said magnet to rotate in response to a magnetic field to which said magnet is exposed.

5. The reflector according to claim 1, further comprising side members extending transversally to said flat portion, wherein said side members have concave edges and wherein said free end of said flat portion and said concave edges are configured to mate with an outer surface of the electronic device.

6. The reflector of claim 1, wherein said reflector is made of a resilient flexible material having a composition selected to cause a free end of said flat portion to form a sealed coupling with the electronic device when said reflector is attached to the electronic device.

7. An electronic device having a loudspeaker, in combination with the reflector according to claim 6, wherein said reflector is attached to said electronic device adjacent said loudspeaker.

8. An electronic device having a loudspeaker, in combination with the reflector according to claim 1, wherein said reflector is attached to said electronic device adjacent said loudspeaker.

9. The reflector of claim 1, wherein said at least one component and said flat portion are constructed to allow said reflector to be mounted on the electronic device.

10. The reflector of claim 1, wherein said at least one component and said flat portion are constructed to cause said reflector to be held in place by said at least one component and said flat portion when said reflector is attached to the electronic device.

11. The reflector of claim 1, wherein said at least one component and said flat portion are constructed to cause said reflector to be clipped onto the electronic device when said reflector is attached to the electronic device.

12. A reflector for enhancing the sound emitted from a loudspeaker of an electronic device, the loudspeaker being disposed at a location on the electronic device, said reflector comprising: at least one component for attaching said reflector to an edge of the electronic device at the location of the loudspeaker; a relatively flat portion adjacent a surface of the electronic device and interconnected thereto by said component for attaching, and a concave portion adjacent to, and extending from said relatively flat portion and presenting a concave surface to the loudspeaker, wherein said concave portion has a free end, the electronic device has an upper surface presenting a forward display screen, and said reflector is dimensioned so that when said reflector is attached to the electronic device, said free end of said concave portion is boated above the loudspeaker of the electronic device in a manner to divert sound in a forward direction.

13. The reflector of claim 12, wherein said at least one component for attaching includes a hook and loop material.

14. The reflector of claim 12, wherein said electronic device is a television.

* * * * *